United States Patent [19]

Leseman et al.

[11] 4,268,598

[45] May 19, 1981

[54] DEVELOPING POWDER COMPOSITION CONTAINING FLUOROALIPHATIC SULFONAMIDO SURFACE ACTIVE AGENT

[75] Inventors: Ronald P. Leseman, Newport; George A. Kurhajec, North Oaks, both of Minn.

[73] Assignee: Minnesota Mining and Manufacturing Company, St. Paul, Minn.

[21] Appl. No.: 84,607

[22] Filed: Oct. 15, 1979

[51] Int. Cl.[3] ..... G03G 9/00

[52] U.S. Cl. ..... 430/107; 430/110

[58] Field of Search ..... 430/105, 106, 107, 108, 430/109, 110, 111, 137

[56] References Cited

U.S. PATENT DOCUMENTS

| | | | |
|---|---|---|---|
| 3,922,381 | 11/1975 | Datta | 430/107 |
| 4,076,641 | 2/1978 | Scouten et al. | 252/62.1 |
| 4,099,968 | 8/1978 | Scouten et al. | 252/62.1 |
| 4,139,483 | 2/1979 | Williams et al. | 430/110 |

*Primary Examiner*—Mary F. Downey

*Attorney, Agent, or Firm*—Cruzan Alexander; Donald M. Sell; James V. Lilly

[57] ABSTRACT

A developing powder composition is provided that comprises a mixture of from about 99.5 to 95% by weight of toner powder particles and correpondingly from about 0.5 to 5% by weight of a fluoroaliphatic sulfonamido surface active material.

17 Claims, 4 Drawing Figures

DEVELOPING POWDER COMPOSITION CONTAINING FLUOROALIPHATIC SULFONAMIDO SURFACE ACTIVE AGENT

BACKGROUND OF THE INVENTION

This invention relates to developing powder compositions. More particularly it relates to developing powder compositions that comprise a mixture of toner powder particles and a fluoroaliphatic sulfonamido surface active agent.

The formation and development of images on surfaces is well known. This may be accomplished via electrographic copying processes. The images formed during these processes are usually developed by means of a developing powder transferred to a receptor (e.g., paper) and fixed thereon.

Many developing powders do not perform satisfactorily when subjected to the rigors of the working environment. For example, the developing powder compositions frequently transfer from the image roll to the receptor in areas other than those desired, i.e., the background areas. This can result in blurred images and overall poor copy quality. These disadvantages are frequently caused by the physical attraction of the developing powder for the image roll in these areas. The present invention, however, provides a novel developing powder composition that reduces this physical attraction thereby improving image and copy quality. Moreover, the present invention provides both heat-fusible and pressure-fixable developing powder compositions.

SUMMARY OF THE INVENTION

In accordance with the present invention there is provided a developing powder composition that comprises a mixture of from about 99.75 to 95% by weight of toner powder particles and, correspondingly, from about 0.25 to 5% by weight of a fluoroaliphatic sulfonamido surface active material.

The developing powder compositions of the present invention are particularly useful in electrographic development processes such as are described in U.S. Pat. No. 3,909,258. They substantially reduce the degree of toner build up that occurs in background areas on the image roll employed in such processes.

Although it is not completely understood how this result is achieved, it is believed that the fluoroaliphatic sulfonamido surface active material coats the surface of the image roll. Since the developing powder compositions of the invention are mixtures of the surface active agent and toner powder particles, the surface active agent is readily available to continually replenish the coating on the image roll. Surprisingly, the surface active material effects this result without adversely affecting the electrical properties of the toner powder particles.

The developing powder composition of the invention offer yet another significant advantage. Thus, they make possible the use of pressure fixable toner powders in place of heat-fusible toner powders in this type of recording process. This offers significant advantages in terms of the speed and efficiency of the process.

Although heat-fusing developing powders have been widely used and have met with commercial success, there are certain disadvantages which are inherent in their use. Such disadvantages relate to the speed and efficiency of the fixing process.

For example, the speed of the fixing process, and hence the speed of the copying or recording process, is limited by the time required to effect fusion of the developer powder. Although the use of more heat to fuse the powder may shorten the fixing time required, this approach is limited by the flammability of the receptor on which the image is fixed. Since paper is widely used as the receptor care must be taken to avoid charring of the paper during the fixing process. Although the speed of the fixing process may also be increased by using lower melting point thermoplastic resins, the resulting image may be smeary and may exhibit poor character definition.

Another disadvantage associated with the use of heat-fusible powders is the significant power consumption of the equipment used for fixing. A further disadvantage is the significant loss of heat energy to the environment.

Yet another disadvantage associated with the use of heat-fusible powders is that the fixing rolls or other equipment used for fixing must first be heated to the requisite temperature before the copying or recording process can begin.

These disadvantages are overcome with the use of the pressure-fixable developing powder compositions of this invention.

DESCRIPTION OF THE DRAWINGS

The present invention will be further explained with reference to the accompanying drawings wherein like reference characters refer to the same elements throughout the several views and wherein.

DETAILED DESCRIPTION OF THE INVENTION

Figure 2:
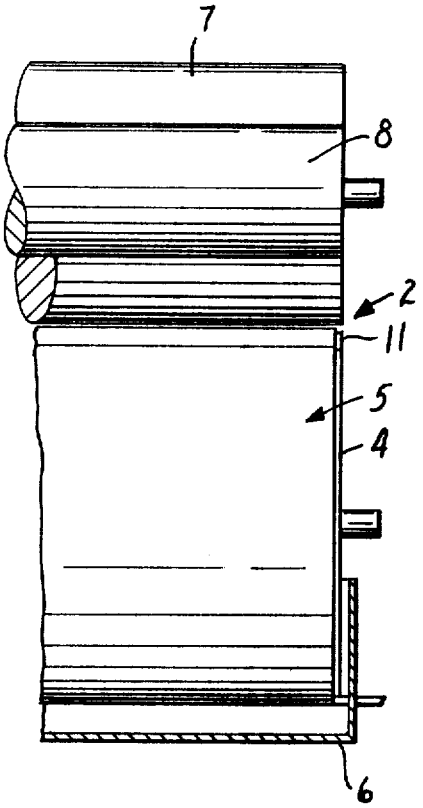
FIG. 2 depicts a side view of the device of FIG. 1 but without showing the web material 10.

The developing powder compositions of the invention may be easily prepared by, for example, blending a fluoroaliphatic sulfonamido surface active agent with a desired formulation of toner powder particles. A uniform mixture of the two components is obtained relatively quickly, e.g., after 15 minutes of mixing.

The fluoroaliphatic sulfonamido surface active materials useful in the present invention are preferably those of the general formula:

$$[R_fQ]_mA \qquad (I)$$

in which $R_f$ is a fluoroaliphatic radical; Q is a divalent sulfonamido-containing group through which $R_f$ and A are joined together; A is a terminal group; and m is equal to the valence of A.

In Formula I, $R_f$ is a monovalent fluorinated aliphatic radical containing at least one carbon atom and preferably a terminal $—CF_3$ group. Where $R_f$ contains a plurality of carbon atoms in a skeletal chain, such chain may be branched or cyclic but preferably is a straight chain. The skeletal chain of carbon atoms can be interrupted by divalent oxygen or trivalent nitrogen hetero atoms, each of which is bonded only to carbon atoms. However, preferably where such hetero atoms are present, the skeletal chain does not contain more than one hetero atom for every two carbon atoms. An occasional carbon-bonded hydrogen atom, bromine atom, or chlorine atom may be present. Where present, however, the hydrogen, bromine, or chlorine atoms preferably are present not more than once for every two carbon atoms in the chain. Thus, the non-skeletal valence bonds are preferably carbon-to-fluorine bonds, that is, $R_f$ is preferably perfluorinated. The total number of carbon atoms of $R_f$ can vary and be, for example, 1 to 18, preferably 1 to 12. Where $R_f$ is or contains a cyclic structure, such structure preferably has 5 or 6 ring member atoms, 1 to 2 of which can be said hetero atoms, i.e., oxygen and/or nitrogen. $R_f$ is preferably free of ethylenic or other carbon-to-carbon unsaturation, that is, it is a saturated aliphatic, alicyclic, or heterocyclic radical. Generally, $R_f$ will contain 40 to 78 weight percent, preferably 50 to 77 weight percent, carbon-bonded fluorine. Examples of $R_f$ radicals are fluorinated alkyl, e.g., $C_4F_9$—, and alkoxyalkyl, e.g., $CF_3OCF_2$—, said radicals being preferably perfluorinated straight-chain alkyl radicals, $C_nF_{2n+1}$ where n is 1 to 12.

The function of the linkage Q is to covalently bond the fluoroaliphatic radical $R_f$ and the terminal group A together in the same molecule. Q contains the sulfonamido group $$-\overset{\overset{O}{\|}}{\underset{\underset{O}{\|}}{S}}-\overset{R^1}{\overset{|}{N}}-R^2-$$

wherein $R^1$ is a lower alkyl group containing from 1 to 8 (preferably 1 to 6) carbon atoms; and $R^2$ is a divalent hydrocarbyl group. Representative examples of useful $R^2$ groups include alkylene (i.e., $-CH_2-_a$ wherein a is from 1 to 16 (preferably 1 to 3)); urethane $$\text{(i.e., } -R^3\underset{\underset{O}{\|}}{O}CNH-\text{);}$$

ester $$\text{(i.e., } -R^3O\text{)}$$

and oxalkylene (i.e., $-R^3O-$) wherein $R^3$ is an alkylene group containing from 1 to 10 carbon atoms.

The linkage Q for a specific compound will be dictated by the ease of preparation of such compound and the availability of necessary precursors thereof.

The terminal group A is bonded through the Q group to the $R_f$ group. The nature of the A group can vary. Thus, for example, A may be an aryl group, an alkenylene group, or may be represented by any of the following formulae $$-\overset{\overset{O}{\|}}{P}-\underset{\underset{OM^2}{|}}{OM^1}$$

$$-\overset{\overset{O}{\|}}{P}-\underset{\underset{|}{}}{OM^1}$$

-continued $$-\overset{\overset{O}{\|}}{\underset{\underset{OM^1}{|}}{C}}-R^4H$$

In the above formulae $R^4$ is an oxalkylene group having from 1 to 10 carbon atoms, an ester group, or a sulfate group; $M^1$ and $M^2$ are selected from hydrogen, alkyl of from 1 to 6 carbon atoms and salt-forming cations such as Group I or Group II metal cation, ammonium, and aliphatic primary, secondary, tertiary, or quaternary ammonium cations, e.g., $R^5NH_3^+$, $R^5{}_2NH_2^+$, $R^5{}_3NH^+$ and $R^5{}_4N^+$, where $R^5$ is alkyl, alkaryl, substituted alkyl or alkaryl (such as hydroxyalkyl) with 1 to 18 carbon atoms.

A preferred subclass of the compounds of Formula I are the fluoroaliphaticsulfonamidophosphonic acids, and salts thereof, of the formula $$R_f-\overset{\overset{O}{\|}}{\underset{\underset{O}{\|}}{S}}-\overset{R^1}{\overset{|}{N}}-(CH_2)_a-\overset{\overset{O}{\|}}{\underset{\underset{OM^2}{|}}{P}}-OM^1 \qquad \text{(II)}$$

in which $R_f$, $R^1$, $M^1$, $M^2$, and a are each as defined above.

Representative compounds of Formula II are:

N-Methyltrifluoromethanesulfonamidomethanephosphonic acid; 2-(N-Methyltrifluoromethanesulfonamido)ethanephosphonic acid; 3-(N-Ethylperfluoroethanesulfonamido)propanephosphonic acid; 3-(N-Methylperfluorohexanesulfonamido)propanephosphonic acid; 3-(N-Ethylperfluorododecanesulfonamido)propanephosphonic acid; 3-(N-Ethylperfluorooctadecanesulfonamido)propanephosphonic acid; 11-(N-Ethylperfluorooctanesulfonamido)undecanephosphonic acid; 6-(N-Methylperfluorobutanesulfonamido)hexanephosphonic acid; 3-(N-Methyl-1,1-dihydroperfluorobutanesulfonamido)propanephosphonic acid; 3-(N-Methylperfluorocyclohexanesulfonamido)propanephosphonic acid; 3-(N-Methyl-1,2-dihydroperfluorobutanesulfonamido)propanephosphonic acid;

3-(N-Methylperfluoroisopropanesulfonamido)propanephosphonic acid; (N-Perfluorooctanesulfonyl-4-methyl)pyrroliden-3-ylmethane-phosphonic acid;

N-Perfluorobutanesulfonylpiperazin-1-ylmethanephosphonic acid;

3-(N-ethylperfluoromethanesulfonamido)propanephosphonic acid;

4-(N-methylperfluorooctanesulfonamido)butanephosphonic acid;

3-(N-ethylperfluorooctanesulfonamido)propanephosphonic acid;

3-(N-ethylperfluorobutanesulfonamido)propanephosphonic acid;

1,1,2,2-tetrahydroperfluorooctanephosphonic acid;

3-perfluorooctanesulfonamidopropanephosphonic acid; and the salts and readily hydrolyzable alkyl esters of the above listed acids.

Compounds of Formula II wherein "a" is from 2 to 16 and $M^1$ and $M^2$ are hydrogen can be prepared by hydrolyzing the esters (1) in turn prepared by free radical-catalyzed addition of a dialkyl phosphite to N-alkenyl-fluoroalkane-sulfonamides (2) where n is 0 to 14 in accordance with the equation:

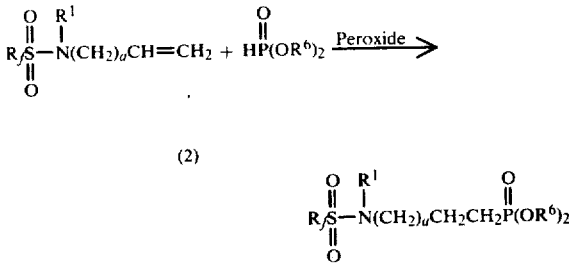

(2) (1)

wherein $R_f$ and $R^1$ are as defined for Formula II, and $R^6$ is alkyl, aryl, or combinations thereof having 1 to 10 carbon atoms. The reaction can be carried out (cf. U.S. Pat. No. 4,067,820) by heating the sulfonamide (2) with an excess of dialkyl phosphite at 100° C. to 200° C. for several hours while adding portion-wise over the heating period about 1 to 5 percent of a peroxide, such as di-t-butyl peroxide. A preferred method of performing the reaction is to concurrently add a solution of the sulfonamide in dialkyl phosphite and a solution of the peroxide in dialkyl phosphite to the dialkyl phosphite heated to 100° C. to 200° C. The product (1) is then isolated by distillation at reduced pressure. The sulfonamides (2) are prepared by procedures known in the art, (cf. U.S. Pat. No. 2,803,656).

Compounds of Formula II wherein "a" is one can be prepared by hydrolyzing the esters (3) prepared by the reaction of fluoroaliphatic sulfonamides (4), such as disclosed in U.S. Pat. No. 2,803,656, with formaldehyde followed by reaction with trialkyl phosphite in accordance with the equations:

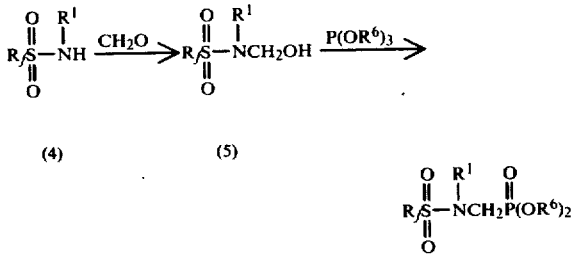

(4) (5) (3)

wherein $R_f$, $R^1$, and $R^6$ are the same as defined above.

A preferred procedure for hydrolysis of the ester precursors of the acids of Formula II involves converting precursor alkanephosphonate esters (7) to trimethylsilyl phosphonates by the method described by McKenna et al, *Tetrahedron Letters*, 1977, and 155 and then adding water, in accordance with the equations:

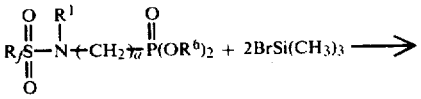

(7)

-continued

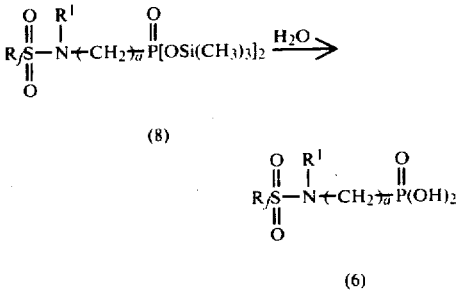

(8) (6)

wherein $R_f$, $R^1$, and $R^6$ are as defined above. The conditions of the reactions are mild. Generally, the first reaction is brought about by heating the alkanephosphonate (7) with excess bromotrimethylsilane at 20° C. to 50° C. for 1 to 100 hours. The second reaction is brought about by stirring the product (8) of the first reaction with excess water at 20° C. to 50° C. for less than about 6 hours, generally less than 1 hour. The phosphonic acids (6) are generally isolated from the reaction mixture by filtration or extraction with diethylether, washed, then dried under reduced pressure.

Compounds of Formula I wherein $M^1$ and $M^2$ are salt-forming cations can be prepared by neutralization of the corresponding phosphonic acids by known procedures, i.e., by reaction with 1 to 2 molar equivalents of base, such as the hydroxide, carbonate, and acetate of suitable cations. The salts of the phosphonic acids can also be prepared by direct saponification of the corresponding alkyl esters by known procedures. Under normal conditions of use, if the phosphonic compounds are added as esters to the glycol solutions, they will be hydrolyzed to the acids or salts.

Other compounds of Formula II and their preparation are known in art and a description of their preparation will be omitted in the interest of brevity.

Another useful subclass of the compounds of Formula I are the ester products of the compounds of Formula II. These compounds can be prepared by the reaction of the corresponding fluoroaliphaticsulfonamidoalkanol with the appropriate acid. Representative ester compounds of this type are the acrylate, butyrate, phosphate, adipate, and sulfate esters.

Another useful subclass of the compounds of Formula I are the fluoroaliphatic sulfonamidoalkanols of the formula:

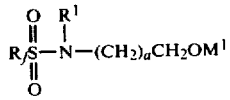

(III)

wherein $R_f$, $R^1$, $M^1$, and a are each as defined above.

Representative compounds of Formula III are: N-propyl-N-ethanol perfluorooctanesulfonamide, N-ethyl-N-butanol perfluorooctanesulfonamide, N-butyl-N-ethanol perfluorooctanesulfonamide, N-ethyl-N-ethanol perfluorooctanesulfonamide, N-ethyl-N-hexanol perfluorooctanesulfonamide, N-ethyl-N-undecanol perfluorooctanesulfonamide, N-methyl-N-undecanol perfluorooctanesulfonamide, and N-methyl-N-butanol perfluorooctanesulfonamide.

Compounds of Formula III can be prepared by reaction of a halohydrin with a sodium or potassium salt of the corresponding perfluoroalkanesulfonamide. Alternatively the corresponding acetate ester may be substituted for the halohydrin if desired. Further description of the method of preparing these compounds may be found in U.S. Pat. No. 2,803,656.

Another useful subclass of the compounds of Formula I are the fluoroaliphatic sulfonamido alkylenemonocarboxylic aicds of the formula:

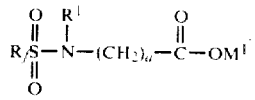

(IV)

wherein $R_f$, $R^1$, $M^1$, and a are each as defined above. Representative compounds of Formula IV are N-ethyl-N-perfluorooctanesulfonylglycine and N-ethyl-N-propionic perfluorooctanesulfonamide. The cation salt derivatives of the compounds of Formula IV are also useful.

Yet another useful subclass of the compounds of Formula I are the fluoroaliphatic sulfonamido phosphate esters of the formula

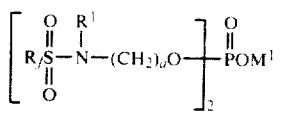

(V)

wherein $R_f$, $R^1$, $M^1$, and a are each as described above. These compounds and their method of preparation are described in U.S. Pat. No. 3,094,547.

Yet another useful subclass of the compounds of Formula I are the fluorocarbon urethane compounds of the formula

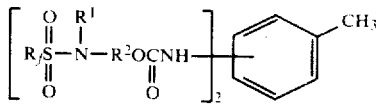

(VI)

wherein $R_f$, $R^1$, and $R^2$ are each as described above. These compounds and their method of preparation are described in U.S. Pat. No. 3,398,182.

The toner powders useful in the present invention are flowable, finely divided dry powders that are generally colored. Both pressure-fixable and heat fusible toner powders may be employed. Preferably they are conductive and magnetically attractable. Most preferably the toner powders employed in the compositions of the invention have a relatively low resistivity. Thus, the toner powders preferably have a resistivity in the range of 0.003 to 0.20 megohms and most preferably a resistivity in the range of 0.09 to 0.15 megohms. Additionally, toner powders useful in the present invention preferably have a particle size in the range of 7 to 20 micrometers and most preferably a size in the range of 10 to 18 micrometers.

Representative examples of pressure-fixable toner powders useful in the present invention include those described in U.S. Pat. No. 3,925,219 wherein the powders are described as comprising (a) from about 50 to 100 parts by weight of a wax component having a melting point between about 45° C. and 150° C. and (b) from about 2 to 50 parts by weight of a thermoplastic resin having a softening point above about 60° C. These toner powders have electrically conductive particles embedded therein.

Another class of pressure-fixable toner powders useful in the present invention is described in U.S. Pat. No. 3,965,022. These powders are described as comprising from about (a) 74 to 98 parts by weight of a thermoplastic component having a low creep compliance and (b) from about 2 to 26 parts by weight of a non-volatile component having a high creep compliance.

Still other pressure-fixable toner powders useful in the present invention are known. They include those described in the following patents:

British Patent No. 1,210,665 which discloses the use of an aliphatic wax, either alone or in admixture with a thermoplastic resin as the toner;

U.S. Pat. No. 3,775,326 which discloses a toner composition comprising 15 to 35% by weight of a polyamide resin, 30 to 50% by weight of a frangible resin such as a rosin modified maleic anhydride-polyhydric alcohol resin, and 2 to 15% by weight of a polyolefinic resin selected from polymethylene and polyethylene; and U.S. Pat. No. 3,829,314 which discloses a composition comprising aliphatic components that have from 6 to 25 carbon atoms, and, optionally thermoplastic synthetic resins.

Representative examples of useful heat-fusible toner powders useful in the present invention include those described in U.S. Pat. No. 3,639,245. These powders are described as being thermoplastic, essentially spherical particles. An electrically conductive material is essentially completely embedded in the particles to provide a radially dispersed zone therein.

Other useful heat-fusible toner powders are described in U.S. Pat. No. 3,377,286. These powders comprise a mass of colored particles containing thermoplastic binder and magnetic powder.

Other useful heat-fusible toner powders are described in U.S. Pat. Nos. 3,590,000; 3,577,345; and 3,694,359. Yet other useful heat-fusible toner powder include Xerox 6500 magenta toner (which is believed to have a binder comprising styrene n-butyl methacrylate copolymer).

Figure 1:
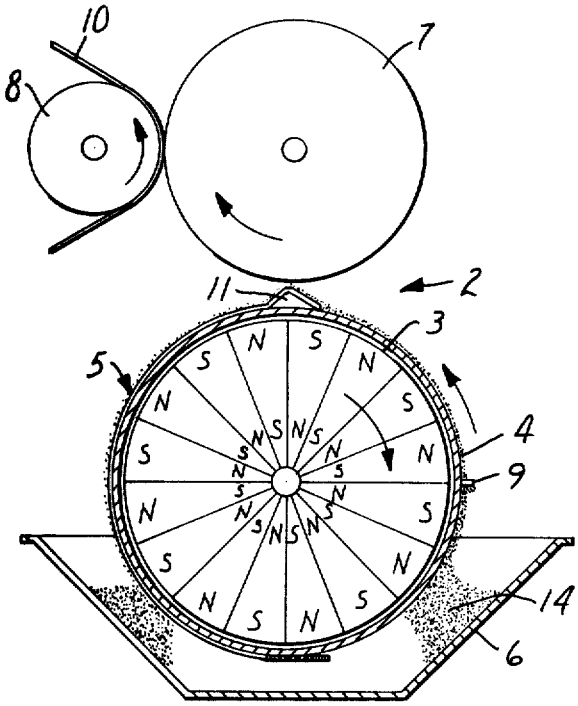
FIG. 1 depicts a cross-sectional view of a printing device useful with the developing powder composition of the invention.

FIG. 1 shows a cross-sectional side view of a printing device 2 useful with the toner powder of the present invention. Device 2 comprises a rotating magnet 3, a powder feed drum 4, a stylus 5, a toner powder hopper 6, an image roll 7, a pressure roll 8. Also provided on device 2 is a metering device 9. A web 10 to be imaged is shown passing through the nip of image roll 7 and pressure roll 8.

Rotating magnet 3 (driving means not shown) comprises a multiple magnet. Preferably it comprises a 16 pole magnet wherein the adjacent magnets have opposite polarity as is shown in FIG. 1. Magnet 3 rotates within powder feed drum 4. In the embodiment shown in FIG. 1, magnet 3 rotates in a clockwise direction.

The powder feed drum 4 is stationary, that is, it does not rotate. It comprises a cylindrical shell that is preferably made of a plastic such as polyvinyl chloride. However, other plastic materials are also useful.

Figure 3:
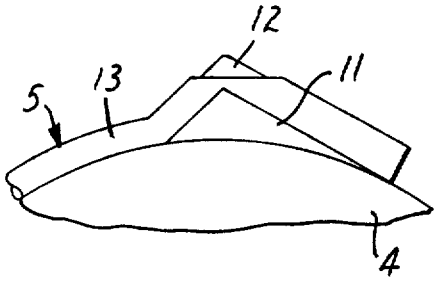
FIG. 3 depicts a portion of the stylus employed with the device of FIG. 1.

Stylus 5 contacts and blankets a portion of powder feed drum 4. One end of stylus 5 goes over a ramp portion 11. The other end of stylus 5 is attached to a voltage source (not shown). The voltage source is programmed so as to provide pulsed voltage to stylus 5. Stylus 5 comprises a parallel array of closely spaced, electrically conductive, fine wires 12. These wires are imbedded in, and separated from one another by, an insulating matrix 13. A portion of matrix 13 is removed from wires 12 at the apex of ramp 11 as is shown more clearly in FIG. 3. This will be further discussed below.

A metering device 9 is also provided on feed drum 4. Metering device 9 provides a uniform layer of toner powder 14 on the surface of feed drum 4.

A portion of powder feed drum 4 and stylus 5 extend into the cavity defined by toner powder hopper 6. Thus, when hopper 6 is filled with toner powder 14, the feed drum 4 and stylus 5 contact said powder.

Image roll 7 is provided above, and in close proximity to, stylus 5 at the apex of ramp 11. Preferably the gap between image roll 7 and stylus 5 at this point is about 75 micrometers. Image roll 7 is maintained at ground potential. The surface of image roll 7 must be capable of accepting an electric potential pattern so that images can be formed thereon. A variety of such surfaces are known. Preferably the surface comprises aluminum. In the embodiment shown in the Figures, image roll 7 rotates in a clockwise direction.

Pressure roll 8 is provided in close proximity to image roll 7. Sufficient gap is provided between rolls 7 and 8 so that a web 10 of material may pass therebetween. Image roll 7 contacts the surface of web 10 that is to be imaged. This surface is sometimes referred to hereinafter as the front surface. Pressure roll 8 contacts the surface of web 10 that is not imaged. This surface is sometimes referred to hereinafter as the back surface.

In operation, magnet 3 is rotated in a clockwise direction within drum 4. This causes toner powder 14, which is magnetically attractable, to move over drum 4 toward stylus 5 in a counterclockwise direction in the manner described in U.S. Pat. No. 3,909,258. As toner powder 14 moves toward stylus 5 it encounters metering device 9. Device 9 causes a uniform layer of the toner powder 14 to form on the surface of drum 4. As toner powder 14 contacts stylus 5 it moves up ramp 11 and, at the apex of the ramp, comes into contact with image roll 7. Powder 14 is not transferred to image roll 7 unles stylus 5 is pulsed with voltage. Typically only selected wires of stylus 5 are pulsed. The wires and the time and duration of the pulse to the wires may be controlled in a variety of ways. However, it is preferred that a microprocessor be employed to program the pulses to their length of time and the wires pulsed. Preferably, the voltage applied to stylus 5 is low, e.g., 10–20 volts.

In any event, where matrix 13 has been removed from wires 12, the voltage applied is sufficient to locally overcome the force of the magnetic field holding the toner powder on stylus 5. Since the toner powder is conductive, it allows a current to flow through it to image roll 7. This creates a localized charge on roll 7 and as roll 7 rotates away from ramp 11 (here in a clockwise direction) powder 14 is attracted to image roll 7 in an image-wise manner in the charged areas.

As image roll 7 rotates away from the apex of ramp 11, the toner powder 14 in non-charged areas of the drum 7 falls away from roll 7. This is facilitated by the geometry of ramp 11 and the magnetic attraction of the toner powder for feed drum 4 in the non-charged areas. Thus, ramp 11 preferably has a relatively low approach angle (e.g., a maximum angle of about 25°). The ramp further preferably has a relatively high exit angle (e.g., at least about 45°). This allows the toner powder to quickly fall from the image roll 7 in non-charged areas. The angles referred to above are measured from the perpendicular to the tangent to powder feed drum 4.

Web 10 passes through the nip area between image roll 7 and pressure roll 8 and the image on roll 7 is transferred to the front side of web 10. Pressure roll 8 provides sufficient force to the backside of web 10 to overcome the forces of attraction between the powder image and roll 7. In the event that the toner powder being transferred is pressure fixable, roll 8 causes the image to be firmly fixed on web 10. If, however, the toner powder being transferred is heat fusible, a heat fusing station (not shown) is provided to cause firm fixation to web 10. Useful heat fusing stations include, for example, high intensity infrared lamps.

Figure 4:
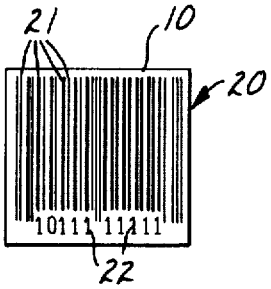
FIG. 4 depicts one product resulting from the use of the device of FIG. 1 and the developing powder composition of the invention.

FIG. 4 shows a particularly preferred type of article 20 prepared using the toner powder composition of the invention and apparatus described above. Article 20 comprises a web 10 having a plurality of vertical bars 21 thereon and a number code 22 at the bottom thereof. Articles of this type are especially useful as price and inventory control labels on selected products. The bars 21 provide a machine readable format.

Web 10 may be selected from a variety of substrates. Preferably it is plain paper. The paper may, if desired, be coated on the front side with an organic thermoplastic resin that is compatible with the toner powder employed. Additionally, the paper may, if desired, have an adhesive applied to its back side so as to provide a label that may be applied to a product or container. Representative examples of useful adhesives include pressure-sensitive adhesives, heat activated adhesives, and water activated adhesives.

In addition to providing price and inventory control labels, the device just described can be used to print tickets (e.g., air, bus, rail, etc.), claim checks, and so forth. Moreover, the information printed may include any character or combination of characters. Thus, the information may include the bar/number code shown in FIG. 4, or, alternatively, letters, symbols, etc.

The following examples further illustrate the present invention.

EXAMPLES 1–10

Developing powder compositions were prepared. The compositions included a toner powder formulation and (optionally) a fluoroaliphatic sulfonamido surface active agent. Control samples of the toner powder with no surface active agent were also prepared. Plain paper labels were prepared using a printer of the type described above and each of the toner powder compositions. A clean image drum was used for each evaluation. The point at which toner build-up on the image drum adversely affected the label quality was noted. The results are given below in Table 1.

The toner powder employed in these examples contained the following ingredients:

| | Parts by Weight |
|---|---|
| Aliphatic/Hydrocarbon Wax ("Polywax 1000"; melting point 110° C., available from Petrolite) | 34.1 |
| Ethylene/vinylacetate copolymer ("Elvax 250" available from DuPont, melting point 138° C.) | 5.9 |
| Magnetite | 55.2 |
| Carbon black ("Vulcan XC-72R" available from Cabot Corporation) | 4.75 |
| Amorphous Colloidal Silica ("Aerosil" available from | |

-continued

The surface active material was then blended with the toner powder by conventional mixing techniques.

TABLE 1

| | TONER POWDER | SURFACE ACTIVE MATERIAL | | |
|---|---|---|---|---|
| EXAMPLE | Concentration (% by weight) | Type | Concentration (% by weight) | LABELS PRINTED (No.) |
| 1 | 99 | $C_8F_{17}S(=O)_2-N(C_2H_5)-CH_2CH_2CH_2P(=O)(OH)-OH$ | 1 | 2000* |
| 2 | 99.9 | $C_8F_{17}S(=O)_2-N(C_2H_5)-CH_2CH_2CH_2P(=O)(OH)-OH$ | 0.1 | Some build up immediately |
| 3 | 99.75 | $C_8F_{17}S(=O)_2-N(C_2H_5)-CH_2CH_2CH_2P(=O)(OH)-OH$ | 0.25 | 1000 |
| 4 | 99.5 | $C_8F_{17}S(=O)_2-N(C_2H_5)-CH_2CH_2CH_2P(=O)(OH)-OH$ | 0.5 | 1500 |
| 5 | 95 | $C_8F_{17}S(=O)_2-N(C_2H_5)-CH_2CH_2CH_2P(=O)(OH)-OH$ | 5 | 3000* |
| 6 | 99 | $C_8F_{17}S(=O)_2-N(C_2H_5)-CH_2C(=O)OH$ | 1 | 2000 |
| 7 | 99.5 | $[C_8F_{17}S(=O)_2-N(C_2H_5)-CH_2CH_2OC(=O)NH]_2-C_6H_4-CH_3$ | 0.5 | 1000 |
| 8 | 99 | $[C_8F_{17}S(=O)_2-N(C_2H_5)-CH_2CH_2O]_2-C_6H_4-CH_3$ | 1 | 400 |
| 9 | 99.5 | $[C_8F_{17}S(=O)_2-N(C_2H_5)-CH_2CH_2O]_2P(=O)-ONH_4$ | 0.5 | 75 |
| 10 | 99 | $[C_8F_{17}S(=O)_2-N(C_2H_5)-CH_2CH_2O]_2P(=O)-ONH_4$ | 1 | 400 |

*No toner build up on image drum noted

| | Parts by Weight |
|---|---|
| Degussa, Inc.) | 0.05 |

The "Polywax", and "Elvacite" were thoroughly blended and then heated until a hot melt solution was obtained. The magnetite was then added to the solution and blended therein until a uniform dispersion was obtained. The dispersion was then spread in a thin layer to cool and solidify.

The solidified composition was then broken into flakes, chilled with dry ice, and reduced to fine powder particles using a hammer mill (e.g., a "Mikro-Pulverizer", commercially available from MikroPul).

These particles were then "spheroidized" such that most of the particles were transformed into spherelike shapes or round-edged particles by known techniques.

The conductive carbon black was thoroughly mixed with the spheroidized particles and embedded into the resin by known techniques. The "Aerosil", a flow agent, was then blended with the powder and the resulting powder was then classified.

When these tests were repeated using developing powder formulations that contained no surface agent, the toner powder adhered to the image drum almost immediately.

What is claimed is:

1. A developing powder composition that comprises a mixture of from about 99.75 to 95% by weight of toner powder particles and correspondingly from about 0.25 to 5% by weight of a fluoroaliphatic sulfonamido surface active material of the formula $[R_fQ]_mA$ wherein $R_f$ is a fluoroaliphatic radical;

Q is a divalent sulfonamido-containing group through which $R_f$ and A are joined together;

A is a terminal group selected from the group aryl, alkenylene,

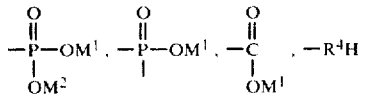

wherein $R^4$ is an oxalkylene group having from 1 to 10 carbon atoms, an ester group, or sulfate group; $M^1$ and $M^2$ are selected from hydrogen, alkyl having from 1 to 6 carbon atoms and salt-forming cations; and m is equal to the valence of A.

2. A developing powder composition according to claim 1 wherein said surface active material has the formula

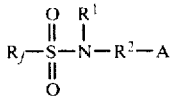

wherein $R^1$ is a lower alkyl group containing from 1 to 8 carbon atoms; and $R^2$ is a divalent hydrocarbyl group.

3. A developing powder composition according to claim 2 wherein said $R^2$ is selected from the group alkylene containing from 1 to 16 carbon atoms,

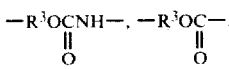

and $—R^3O—$, wherein $R^3$ is an alkylene group containing from 1 to 10 carbon atoms.

4. A developing powder composition according to claim 3 wherein said $R^2$ is an alkylene group containing from 1 to 16 carbon atoms.

5. A developing powder composition according to claim 4 wherein A is

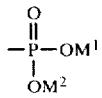

wherein $M^1$ and $M^2$ are each selected from hydrogen, alkyl groups containing from 1 to 6 carbon atoms, and salt forming cations.

6. A developing powder composition according to claim 5 of the formula

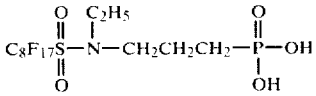

7. A developing powder composition according to claim 4 wherein A is

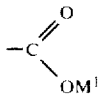

wherein $M^1$ is selected from hydrogen, alkyl groups containing from 1 to 6 carbon atoms, and salt forming cations.

8. A developing powder composition according to claim 7 of the formula

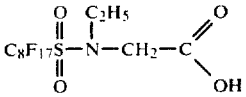

9. A developing powder composition according to claim 4 wherein A is $—R^4H$ wherein $R^4$ is an oxalkylene group having from 1 to 10 carbon atoms.

10. A developing powder composition according to claim 9 of the formula

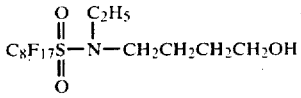

11. A developing powder composition according to claim 3 wherein $R^2$ is

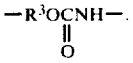

12. A developing powder composition according to claim 11 of the formula

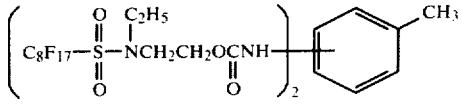

13. A developing powder composition according to claim 3 wherein $R^2$ is

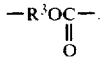

14. A developing powder composition according to claim 13 of the formula

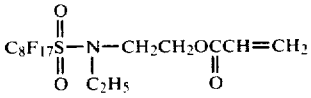

15. A developing powder composition according to claim 3 wherein $R^2$ is $—R^3O—$.

16. A developing powder composition according to claim 15 wherein A is

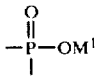

wherein $M^1$ is selected from hydrogen, alkyl groups containing from 1 to 6 carbon atoms and salt forming cations.

17. A developing powder composition according to claim 16 of the formula

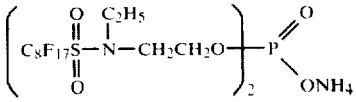

* * * * *